US007150050B2

(12) United States Patent
Sharp

(10) Patent No.: US 7,150,050 B2
(45) Date of Patent: Dec. 19, 2006

(54) TODDLER TOILET TRAINER AND METHOD

(76) Inventor: Michelle E. Sharp, 5017 Highlands Dr., McKinney, TX (US) 75070

( * ) Notice: Subject to any disclaimer, the term of this patent is extended or adjusted under 35 U.S.C. 154(b) by 92 days.

(21) Appl. No.: 10/859,419

(22) Filed: Jun. 1, 2004

(65) Prior Publication Data

US 2005/0188455 A1 Sep. 1, 2005

Related U.S. Application Data

(60) Provisional application No. 60/548,442, filed on Feb. 27, 2004.

(51) Int. Cl.
*A47K 11/06* (2006.01)

(52) U.S. Cl. ..... 4/484; 383/77

(58) Field of Classification Search ..... 4/484; 383/77; 220/495.1
See application file for complete search history.

(56) References Cited

U.S. PATENT DOCUMENTS 3,107,842 A * 10/1963 Guilfoyle ..... 383/62
4,509,215 A 4/1985 Paz
D354,342 S 1/1995 Marshall-Smith
D381,070 S 7/1997 Deniakis et al.
D402,739 S 12/1998 Mc Clements
6,115,855 A 9/2000 Lorenzo
6,532,605 B1 3/2003 Howell
6,694,535 B1 2/2004 Gianesi Gschwind
2004/0158918 A1* 8/2004 Lopes et al. ..... 4/484

* cited by examiner

*Primary Examiner*—Charles E. Phillips
(74) *Attorney, Agent, or Firm*—Jackson Walker L.L.P.; Robert C. Klinger

(57) ABSTRACT

A liner (200) for the waste receiving container (104) of a toddler potty trainer seat (100) comprises a liquid impervious outer shell (201) having exterior dimensions closely matched to the interior dimensions of the waste receiving container (104). An elastic band (202) extends around the upper end of the liquid impervious outer shell (201) to secure the liner (200) in engagement with the container (104). A liquid retaining layer (203) extends across substantially the entirety of the interior surface of the liquid impervious outer shell (201). An inner layer (204) extends across the entirety of the liquid retaining layer (203) for passing liquid received in the liner (204) into the liquid retaining layer (203) and for changing color in response to use.

17 Claims, 2 Drawing Sheets

TODDLER TOILET TRAINER AND METHOD

CLAIM OF PRIORITY

This application claims priority under 35 U.S.C. Section 119(e) to U.S. Patent Application Ser. No. 60/548,442, Sharp, filed Feb. 27, 2004, entitled "Liner For Toddler Potty Trainer Seats", the entire contents of which are incorporated herein by this reference.

BACKGROUND

Toilet training for toddlers typically involves the use of a waste receiving seat construction. In a conventional training seat, there is provided a base which is received and supported on an underlying surface. The base is provided with a guide which receives and positions a waste receiving container. The seat is removably supportable on the base and is provided with a waste directing aperture which is aligned with the waste receiving container.

Using the toddler potty trainer seat, the toddler is trained to "go to the bathroom" on the seat. When the activity is completed the seat is disengaged from the base and the waste receiving container is utilized to transport the waste to a conventional toilet for disposal. Thereafter it is necessary to carefully clean the waste receiving container prior to reuse.

SUMMARY

The present invention relates generally to toilet training for toddlers, and more particularly to a liner construction useful in conjunction with toddler potty trainer seats to facilitate capture and disposal of waste. The liner construction also provides positive reinforcement to the toddler during the training process.

The present invention comprises a novel waste receiving liner for the waste receiving container of a toddler potty trainer seat. A retaining device is provided which facilitates disposal of the liner with the waste contained therein. In this manner, utilization of the toddler potty trainer seat at locations remote from a conventional toilet is facilitated. Also, use of the liner in the present invention eliminates the necessity of thoroughly cleaning the waste receiving container after each use.

In accordance with more specific aspects of the present invention, a liner for the waste receiving container of a toddler potty trainer seat comprises a liquid impervious outer shell having exterior dimensions which closely match the interior dimensions of the waste receiving container in which it will be used. An elastic band is provided around the upper edge of the liquid impervious outer shell for securing the liner in place within a waste receiving container. The interior of the liner comprises a liquid receiving layer which may be either foam or fibrous in construction. The liquid receiving layer is covered by an inner layer which changes color following use. The changed color of the inner layer can be viewed from above the waste receiving container, providing the toddler with positive reinforcement when using the trainer seat and can also be used as a reference to determine if the liner is soiled. A retaining tab is secured to the exterior of the liquid impervious outer shell for securing the liner in a closed configuration following use.

BRIEF DESCRIPTION OF THE DRAWINGS

Advantages of the present invention and the specific embodiments will be understood by those of ordinary skill in the art by reference to the following detailed description of the present invention taken in conjunction with the drawings, in which.

DETAILED DESCRIPTION OF THE INVENTION

The numerous innovative teachings of the present invention will be described with particular reference to the preferred embodiments disclosed herein. However, it should be understood that the embodiments described provide only a few examples of the many advantageous uses and innovative teachings herein. In general, statements made in the specification of the present application do not necessarily delimit any of the various claimed inventions. Moreover, some statements may apply to some inventive features, but not to others.

Figure 1:
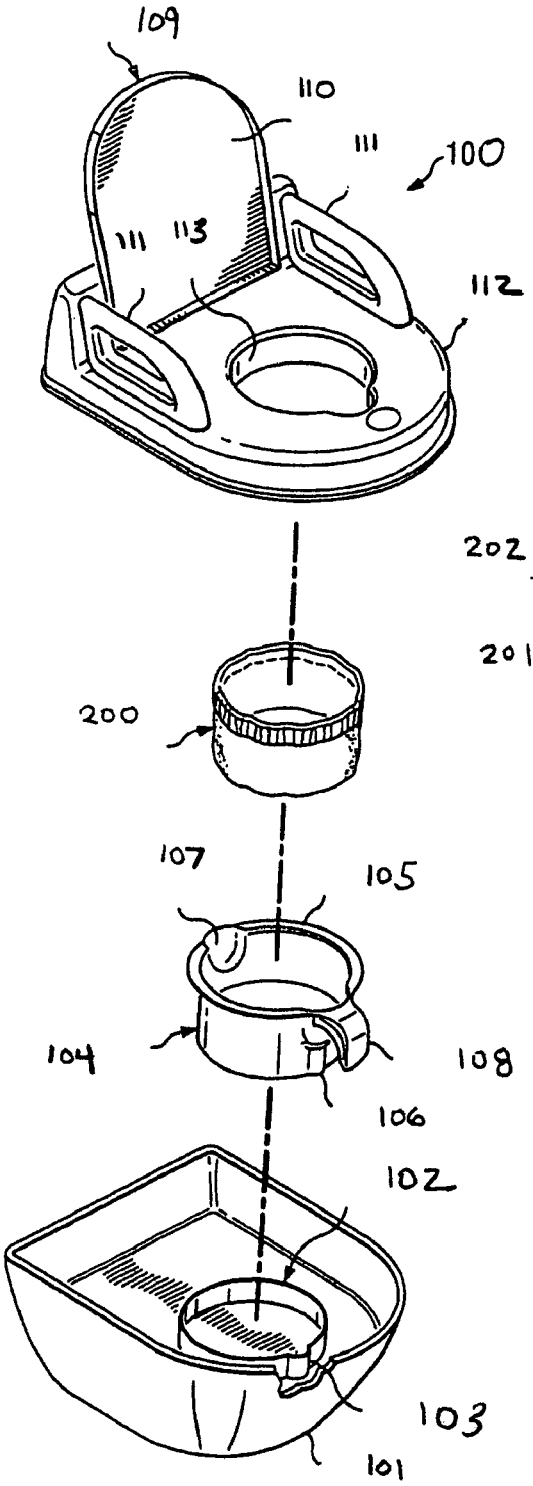
FIG. 1 is an exploded view illustrating the use of the liner of the present invention for waste containers of toddler potty trainer seats.

Referring to the drawings, and particularly to FIG. 1 thereof, there is shown a typical toddler potty trainer seat 100. The toddler potty trainer seat 100 includes a base 101 which may be weighted to prevent tipping. The base 101 includes a guide 102 adapted to receive and position a waste receiving container 104. To this end the guide 102 is provided with a positioning detent 103.

The toddler potty trainer seat 100 further includes a waste receiving container 104 having an upper edge or lip 105. The waste receiving container 104 is received in the guide 102 and is provided with a projection 106 which is received in the detent 103 of the guide 102 to assure the proper positioning of the container 104. The container 104 may be provided with a pouring spout 107. A handle 108 may be provided for use in manipulating the waste receiving container 104.

A seat 109 completes the construction of the toddler potty trainer seat 100. The seat 109 includes a back 110, arms 111, and a platform 112 which is removably secured on the base 101. The platform 112 is provided with a waste directing aperture 113 which is aligned with the waste receiving container 104 when the container 104 is positioned in the guide 102 of the base 101 and the seat 109 is engaged with the base 101.

As is well known to those skilled in the art, waste resulting from use of the toddler potty trainer seat 100 may be received directly in the waste receiving container 104. In such instances the container 104 is utilized to transport the waste to a conventional toilet for disposal. Thereafter, the waste receiving container 104 must be thoroughly washed prior to reuse.

Figure 2:
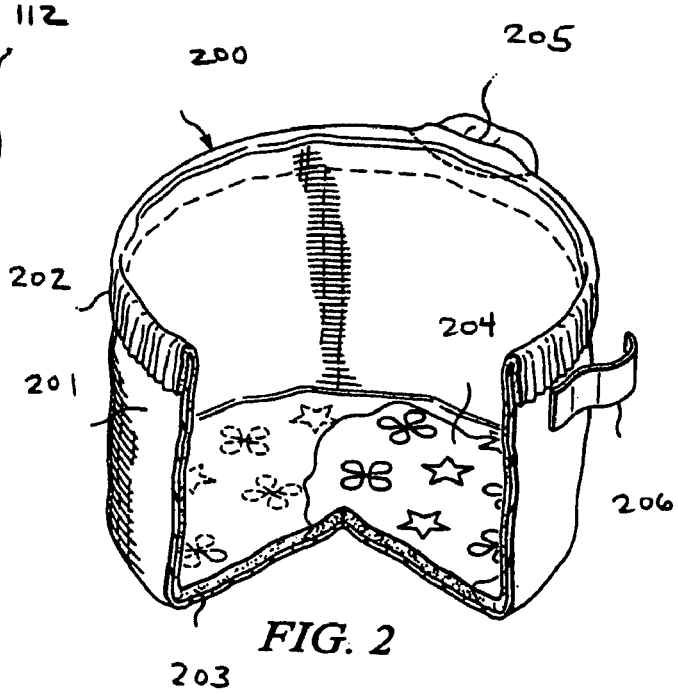
FIG. 2 is a perspective view of a first embodiment of the liner of the present invention in which certain parts have been broken away more clearly to illustrate certain features of the invention.

In accordance with the present invention there is provided a liner 200 for use in conjunction with the waste receiving container 104 of the toddler potty trainer seat 100. Referring particularly to FIG. 2, a first embodiment of the liner 200 comprises a liquid impervious outer shell 201 which may be formed from a suitable plastic film material. The exterior dimensions of the shell 201 are closely matched to the interior dimensions of the waste receiving container in which the liner 200 will be utilized. An elastic band 202 is provided at the upper edge of the liquid impervious outer shell 201. The stretchable elastic band 202 receives the upper edge or lip 105 of the container 104 to secure the liner 200 in engagement with the container 104.

The liner 200 is provided with a liquid absorbent retaining layer 203. The liquid retaining layer 203 may be formed from a foam material, or from a fibrous material depending upon the requirements of particular applications of the invention. The thickness of the absorbent liquid retaining layer 203 may be greater in the region of the bottom of the liner 102 as compared with the thickness of the layer 203 in the side walls of the liner 200. The liner 200 further comprises an inner layer 204 formed from a material that allows liquid to pass directly therethrough into the liquid retaining layer 203. Preferably the layer 204 is constructed so as to provide an indicia when the liner has received liquid. For example, the layer 204 may be decorated in an appropriate motif, such as cartoon characters or designs, if desired. The motif may be slightly visible or invisible, or have a first color, when the liner has not had a liquid incident thereon. However, the motif may darken, become visible, or change to a second color, when a liquid is flows through layer 204 and is incident on layer 203. In this manner, one can view the interior of liner 200 and determine whether liner 200 requires replacement. A slit 205 may be formed through the layers comprising the liner 202 for receiving the handle 108 of the waste receiving container 104. A retaining tab 206 is secured to the exterior of the liquid impervious outer shell 201 of the liner 200.

Figure 3:
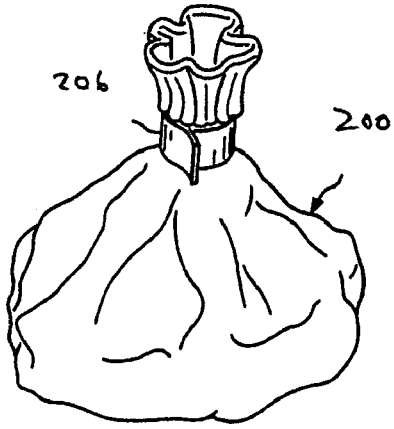
FIG. 3 is an illustration of the first embodiment of the liner of the present invention following use and secured for disposal.

As illustrated in FIG. 3, the retaining tab 206 is adapted to secure the liner 200 in a closed configuration following the receipt of waste therein. In this manner disposal of the liner 200 with waste retained therein is facilitated. The retaining tab may have coupled thereto a hook and loop fastening mechanism or single or double sided reusable tape or adhesive.

Figure 7:
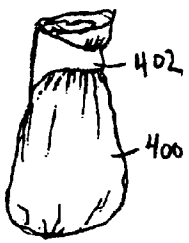
FIG. 7 is an illustration of the second embodiment liner of the present invention following use and secured for disposal.
Figure 4:
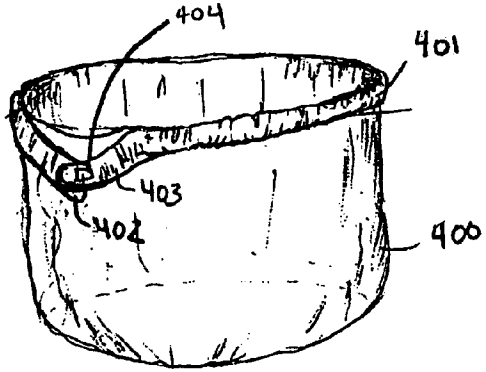
FIG. 4 is a perspective view of a second embodiment of the liner of the present invention with the elastic upper edge folded over.

FIG. 4 is a perspective view of a second embodiment of the liner 400 of the present invention with the elastic upper edge 401 folded over. As seen therein, instead of a slit through which the handle 108 is inserted, a pair of tabs, 402 and 403, having a fastening mechanism coupled thereto, such as an adhesive or single or double sided tape, which may have a binding characteristic making it reusable, on one tab aposition the other tab, or a hook mechanism on one tab aposition a loop mechanism on the other tab (e.g., Velcro(r)), are provided. In this manner, the tabs, 402, 403, when apart, are disposed under the handle of the waste container, then overlap with each other, allowing the tabs to be coupled thereunder to each other in one embodiment, and, in a further embodiment, to the outer wall of the waste container. For example, one or both of the tabs 402, 403 may have a fastening mechanism aposition the outer wall of the waste container. If the fastening mechanism is an adhesive or reusable tape, then no specific coupling mechanism is needed on the outer wall of the waste container. However, the outer wall of waste container may be treated so as to allow the adhesive or tape to be easily removed therefrom. The tabs can be coupled to each other and then to the outer wall of the waste container, or each can be individually coupled to the outer wall of the waste container. The foregoing fastening mechanism is adapted to provide a more secure fit of the liner 400 to the waste container in combination with the elastic edge 401 of liner 400 around the lip 105 of waste container 104. A further coupling mechanism, such as adhesive portion 404, can be placed on the opposing side of each tab aposition the waste container wall, to facilitate the leak proof securing of the liner 400 after it has been used, as seen in FIG. 7. As seen therein, the tape or adhesive 404 is on the inside of the liner 400 when the edge 401 is in the unfolded position. The tape of adhesive 404 is on the outside of the liner 400 when the edge is folded over, as seen in FIG. 4. Each of the tabs 402,403 are elastic and stretchable.

Figure 5:
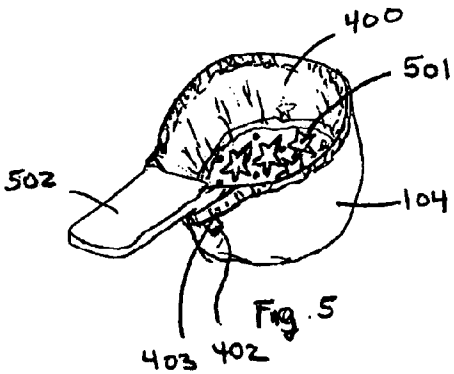
FIG. 5 is a perspective view of a second embodiment of the liner of the present invention as placed in waste receiving container, showing a star motif on the interior of the liner.

FIG. 5 is a perspective view of a second embodiment of the liner of the present invention as placed in waste receiving container 104, showing a star motif 501 on the interior of the liner 400. As previously discussed, the motif may be slightly visible or substantially invisible, or a certain color, when the liner has not had a liquid incident thereon. However, the motif may darken, become visible, or change to a second color, when a liquid is incident on the liner 400. This mechanism can be implemented using a substantially opaque liquid absorbent layer 204 over the absorbent layer 203. The layer 204 or absorbent layer 203 has imprinted therein, the figures of the motif. When a liquid is incident on the liquid absorbent layer 204, the substantially opaque surface may become substantially translucent or transparent. Alternatively, an ink can be used on either layer 204 or 203 that is adapted to change colors or darken in a chemical reaction when a liquid of a certain composition is incident thereon. In this manner, one can view the interior of the liner and, depending on the status of the motif, determine whether the liner requires replacement. The use of a motif that is appealing to a toddler can also be used to provide positive reinforcement to the child. In order to view the motif, the child must first use the training seat. As further seen in FIG. 5, tabs 402, 403 are disposed under handle 502 of waste container 104 and coupled to each other.

Figure 6:
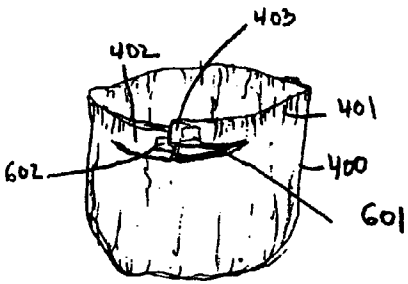
FIG. 6 is a perspective view of a second embodiment of the liner of the present invention with the elastic upper edge unfolded.

FIG. 6 is a perspective view of a second embodiment of the liner 400 of the present invention with the elastic upper edge 401 unfolded to show adhesive tape portions 601, 602 on tabs 403, 402, respectively.

FIG. 7 is an illustration of the second embodiment of the liner 400 of the present invention having been secured for disposal. As seen therein, adhesive portions 404 on tabs 402, 403, after being removed from the waste container 104, can be used to secure the liner 400 for no-leak disposal.

The use of the disclosed embodiments of the liner of the present invention is advantageous in that it facilitates utilization of a toddler potty trainer seat in locations which are remote from a conventional toilet. The use of the liner of the present invention is further advantageous in that it eliminates the need to thoroughly wash the waste receiving container of a toddler potty trainer seat following each use thereof. The use of the present invention provides positive reinforcement to the toddler, which lessens the time and effort necessary to toilet train the toddler. The use of the liner of the present invention decreases or eliminates the need to continually clean the waste container, improves the sanitary condition of the waste container and areas proximate thereto Although preferred embodiments of the present invention are illustrated in the accompanied drawings and described in the foregoing detailed description, it will be understood that the invention is not limited to the embodiments disclosed but is capable of numerous rearrangements, modifications and substitutions in parts and elements without departing from the spirit of the invention. For example, any number of fastening mechanisms on the tabs of the liner can be used to accomplish the objectives of restraining the liner to the waste container, and thereafter can be used to secure the liner for disposal. Further, any number of motifs, such as cartoon characters or appealing designs, in the liner can be used to serve to motivate use of the trainer by the toddler and serve as an indicia that the liner needs to be replaced.

I claim:

1. A liner adapted to be received in a waste receiving container having a outwardly extending handle, comprising:

a liquid impervious outer shell forming a receptacle;

a liquid absorbent retaining layer stratified to the interior of the outer shell and facing the receptacle; and the liner having an upper edge defining an annular portion, wherein the annular portion of the liner has a recess and comprises opposing tabs on each side of the recess, adapted to couple to each other below the waste receiving container handle when disposed in the waste receiving container.

2. The liner of claim 1, further comprising: an inner layer extending over a central portion of the liquid absorbent retaining layer for passing liquid human waste received upon the liner into the liquid absorbent retaining layer; and the inner layer adapted to visually change from a first state to a second state in response to contact with liquid human waste.

3. The liner of claim 2, wherein the first state comprises the absence of a motif and the second state comprises a visible motif.

4. The liner of claim 2, wherein the first state comprises a visible motif of a first color and the second state comprises a visible motif of a second color.

5. The liner of claim 1, wherein each of the tabs is elastic and stretchable.

6. The liner of claim 1, further comprising an elastic band secured to the upper edge of the liquid impervious outer shell adapted to secure the liner in engagement with the waste receiving container.

7. The liner of claim 1, further comprising the liquid absorbent retaining layer extending across substantially the entirety of the interior of the liquid impervious outer shell.

8. In combination:

a waste receiving container having an open top and closed bottom and a handle;

a liner having a liquid impervious outer shell and having exterior dimensions closely matched to the interior dimensions of the waste receiving container; and the liner having an upper edge defining an annular portion and a recess including a liquid absorbent retaining layer stratified to the interior of the outer shell, wherein the annular portion of the liner has a recess and opposing tabs on each side of the recess, adapted to couple to each other below the waste receiving container handle when disposed in the waste receiving container.

9. The combination of claim 8, further comprising: an inner layer extending over a central portion of the liquid absorbent retaining layer for passing liquid human waste received upon the liner into the liquid absorbent retaining layer; and the inner layer adapted to visually change from a first state to a second state in response to contact with liquid human waste.

10. The combination of claim 9, wherein the first state comprises the absence of a motif and the second state comprises a visible motif.

11. The combination of claim 9, wherein the first state comprises a visible motif of a first color and the second state comprises a visible motif of a second color.

12. The combination of claim 8, wherein each of the tabs is elastic and stretchable.

13. The combination of claim 8, further comprising an elastic band secured to the upper edge of the liquid impervious outer shell adapted to secure the liner in engagement with the waste receiving container.

14. The combination of claim 8, further comprising the liquid absorbent retaining layer extending across substantially the entirety of the interior of the liquid impervious outer shell.

15. The combination of claim 8, wherein the waste receiving container has a lip extending around the upper edge thereof and the liner has an elastic band engaging the lip of the waste receiving container in secure engagement therewith.

16. The combination of claim 8, further comprising a toilet training seat coupled to the waste receiving container.

17. The combination of claim 8, wherein the waste receiving container has a handle extending therefrom and further including a slit formed through the layers comprising the liner for receiving the handle of the waste receiving container.

* * * * *